US009468056B2

(12) United States Patent
Barnett et al.

(10) Patent No.: US 9,468,056 B2
(45) Date of Patent: Oct. 11, 2016

(54) IN AND RELATING TO DISPLAYS AND LIGHT SOURCES FOR DISPLAYS

(71) Applicant: BAE SYSTEMS plc, London (GB)

(72) Inventors: Keith Barnett, Rochester (GB); Peter John Smith, Rochester (GB); Tom Cronin, Rochester (GB)

(73) Assignee: BAE SYSTEMS plc, London (GB)

( * ) Notice: Subject to any disclaimer, the term of this patent is extended or adjusted under 35 U.S.C. 154(b) by 0 days.

(21) Appl. No.: 14/902,703

(22) PCT Filed: Jul. 7, 2014

(86) PCT No.: PCT/GB2014/052062
§ 371 (c)(1),
(2) Date: Jan. 4, 2016

(87) PCT Pub. No.: WO2015/001363
PCT Pub. Date: Jan. 8, 2015

(65) Prior Publication Data

US 2016/0174317 A1 Jun. 16, 2016

(30) Foreign Application Priority Data

Jul. 5, 2013 (EP) ..... 13275158
Jul. 5, 2013 (GB) ..... 1312061.3

(51) Int. Cl.
*H05B 33/08* (2006.01)

(52) U.S. Cl.
CPC ..... *H05B 33/0827* (2013.01); *H05B 33/0815* (2013.01); *H05B 33/0812* (2013.01); *H05B 33/0845* (2013.01)

(58) Field of Classification Search
USPC ..... 315/247, 224, 209 R, 185 S, 291, 315/307–326
See application file for complete search history.

(56) References Cited

U.S. PATENT DOCUMENTS

| | | | |
|---|---|---|---|
| 5,936,599 | A | 8/1999 | Reymond |
| 2008/0116818 | A1 | 5/2008 | Shteynberg et al. |
| 2008/0272743 | A1 | 11/2008 | Ackermann et al. |
| 2010/0253302 | A1 | 10/2010 | Otte et al. |
| 2011/0210679 | A1 | 9/2011 | Koepke et al. |
| 2011/0260535 | A1 | 10/2011 | Wanner et al. |
| 2012/0217898 | A1 | 8/2012 | Pansier |

FOREIGN PATENT DOCUMENTS

| | | | |
|---|---|---|---|
| WO | 2009060400 | A1 | 5/2009 |
| WO | 2009129830 | A1 | 10/2009 |
| WO | 2015001363 | A1 | 1/2015 |

OTHER PUBLICATIONS

International Search Report and Written Opinion received for Patent Application No. PCT/GB2014/052062, mailed on Aug. 18, 2014. 14 pages.
GB Intellectual Property Office Search Report under Section 17(5) received for GB Patent Application No. 1312061.3 mailed Dec. 12, 2013. 4 pages.
Extended European Search Report received for EP Patent Application No. 13275158.7 mailed Dec. 2, 2013. 7 pages.
International Preliminary Report on Patentability received for Patent Application No. PCT/GB2014/052062, mailed on Jan. 14, 2016. 11 pages.

*Primary Examiner* — Tuyet Vo
(74) *Attorney, Agent, or Firm* — Finch & Maloney PLLC

(57) ABSTRACT

A light source for a color display apparatus (1) for displaying light at optical wavelengths corresponding a plurality of different colors sequentially, comprising a plurality of light-emitting diodes (3, 4, 5) each respectively operable to emit light to display a respective one of the plurality of different colors, a power source (26) connected to the plurality of LEDs for supplying power thereto a plurality of capacitor units (7, 8, 9) connected to the power source to be provided thereby with charge for generating a respective one of a plurality of different respective forward bias voltages for application to the LEDs to operate the LED. A control unit (10) is operable to selectively connect a capacitor unit to an LED for applying a desired one of the different said forward bias voltages thereto according to the color of light which the LED is operable to display.

20 Claims, 5 Drawing Sheets

IN AND RELATING TO DISPLAYS AND LIGHT SOURCES FOR DISPLAYS

FIELD OF THE INVENTION

The invention relates to displays using light-emitting diodes (LED) and to the control of LEDs for generating light for such displays. In particular, though not exclusively, the invention is suitable for use in displays such as head-up displays or helmet/head-mounted displays, especially colour displays.

BACKGROUND

Colour displays typically work according to one of two general principles of operation. A first principle is the transmissive display principle in which a transmissive display screen (e.g. liquid crystal display) is back-lit by a white-light illumination source. Red, green and blue filter elements within the display screen selectively block or transmit light from the back light to produce a colour display. A second principle is that of colour sequential display whereby a display element is illuminated sequentially with red, green and blue light either from a colour wheel spinning in front of a white light source or three separate LEDs arranged to generate red, green and blue light respectively.

In the latter case, when driving LEDs the forward bias voltage of each LED is controlled to remain largely stable (varying a little) and brightness/luminous output of the LED is controlled by controlling the current through the LED. This is because, in having a diode voltage/current characteristic, current in a driven LED is approximately an exponential function of forward bias voltage according to the Shockley diode equation, so a small voltage change will result in a large corresponding current change. However, if the voltage is too high, the corresponding current may rise above the maximum rating for an LED and potentially damage it. Therefore, it is important that the power source connected to an LED provides the correct current. LEDs are typically connected to constant-current power sources as a result of this driven by a driver/control circuit to ensure that appropriate voltages/currents are applied to the LED. This means that in a colour display that employs sequentially-driven LEDs (e.g. red, green and blue), a colour-dedicated driver/control circuit is required for each LED colour since LEDs designed to produce red light require forward bias voltages (current) which differ from those required to drive an LED designed to produce blue or green light—the same being true as between blue and green LED driving requirements. Thus, a control circuit adapted to drive a red LED is unsuitable for driving a blue or green LED, and vice versa, and a control circuit adapted to drive a blue LED is unsuitable for driving a green LED, and vice versa. This unsuitability is also driven by the energy of photons generated by an LED, which is given by $h\nu$, where h is Planck's constant and $\nu$ is the frequency of the photon. Generated blue light typically has a frequency of about $\nu$=2.17 TeraHertz, green has $\nu$=1.9 Terahertz and red has $\nu$=1.61 TeraHertz. Blue photons are more energetic than green which are more energetic than red. This leads to widely varying power requirements for each type of colour LED and therefore the lowest energy LED device (red) must be driven at a much higher power than the green or blue LEDs, but as the forward voltage for a red LED is typically much lower than the forward voltages for green and blue LEDs, the amount of current required in each channel varies by a large factor.

This adds much cost to the production of drivers for colour displays employing different colour LEDs, and also significantly increases the size and weight of the display circuitry as a whole—which is particularly disadvantageous in helmet-mounted or head-mounted displays.

The invention aims to provide an improved display apparatus using LEDs.

SUMMARY OF THE INVENTION

In a first aspect, the invention provides a light source for a colour display apparatus for displaying light at optical wavelengths corresponding a plurality of different colours sequentially, comprising a plurality of light-emitting diodes (LED) each respectively operable to emit light to display a respective one of the plurality of different colours, a power input part for connecting the plurality of LEDs to a power supply for supplying power thereto, the power input part including a plurality of current sensing units, each current sensing unit being selectable in respect of one of the plurality of LEDs to apply a corresponding limit to the level of current that may be supplied thereto by the power supply, a plurality of capacitor units connected to the input part to be provided with charge from a said power supply for generating a respective one of a plurality of different respective forward bias voltages for application to the LEDs to operate the LEDs and, a control unit operable to connect selectively a said capacitor unit to a said LED for applying a desired one of said different said forward bias voltages thereto according to the colour of light which the LED is operable to display and to select a corresponding one of said plurality of current sensing units for the LED. The light source may include the power source connected to the input part. A particular benefit of providing a plurality of pre-chargeable capacitors to provide appropriate forward bias voltages is that the correct forward bias voltage may be applied to the necessary LED immediately it is required. There is no requirement to wait while a power supply unit generates a new forward bias voltage after having dispensed with a previous one. Rather, the required forward bias voltage is ready and waiting when needed. Higher frame rates are enabled in a display employing such a light source, as well as avoiding damaging power spikes and electromagnetic emissions and heat typically generated in existing systems.

The control unit is preferably operable and arranged to selectively connect a said capacitor unit to a said LED for a first period of time for operating the LED, and to subsequently disconnect the capacitor unit from the LED to remove the desired forward bias voltage for a finite second period of time before subsequently connecting any other said capacitor to any said LED. The finite second period of time is preferably not less than about 20 ns in duration, and more preferably not less than about 30 ns and even more preferably not less than about 50 ns. The finite second period of time is preferably not greater than about 200 ns in duration, and more preferably not greater than about 150 ns and even more preferably not greater than about 125 ns. (e.g. about 100 ns). These limits to the second period have been found to be particularly effective in ensuring efficient operation of the apparatus.

One terminal of a said capacitor may be connected to an anode of a respective LED and another terminal of the capacitor may be selectively connectable to ground via a first respective switch. A cathode of the respective LED may be selectively connectable to ground via a second respective switch, wherein the control unit may be operable and arranged to selectively connect a said capacitor unit to a said LED by concurrently closing both the first and second respective switches, and to selectively disconnect a said capacitor unit from a said LED by concurrently opening both the first and second respective switches.

The control unit may be operable and arranged sequentially to connect different said capacitor units to different said LEDs of the different colours such that each said colour is displayed in turn before a given colour is re-displayed.

The plurality of capacitor units preferably differ from one another in respect of their capacitance thereby to provide different forward bias voltages when provided with charge from the power source.

The plurality of different colours may comprise substantially red, substantially green and substantially blue and each said LED is arranged respectively to emit light to display a respective one of substantially red, substantially green and substantially blue.

The invention may provide a colour display apparatus including the light source. The light source (or colour display apparatus) may include a display screen comprising the plurality of LEDs. The light source (or colour display apparatus) may comprise a projector part for projecting light generated by the plurality of LEDs.

In a second aspect, the invention may provide a head-mounted display apparatus comprising the light source (or colour display apparatus) described above.

In a third aspect, the invention may provide a head-up display apparatus comprising the light source (or colour display apparatus) described above.

In a fourth aspect, the invention may provide a helmet-mounted display apparatus comprising the light source (or colour display apparatus) as described above.

In a fifth aspect, the invention may provide a colour generation and/or display method for use in displaying light at optical wavelengths corresponding a plurality of different colours sequentially, comprising providing a plurality of capacitor units connected to a power source and to a respective one of a plurality of light-emitting diodes (LED) each arranged to emit light to display a respective one of said plurality of different colours, providing each capacitor with charge from the power source for generating a respective one of a plurality of different respective forward bias voltages for application to the LEDs to operate the LEDs, selectively connecting a said capacitor unit to a said LED for applying a desired one of the different said forward bias voltages thereto according to the colour of light which the LED is operable to display.

The method may include selectively connecting a said capacitor unit to a said LED for a first period of time for operating the LED, and subsequently disconnecting the capacitor unit from the LED to remove the desired forward bias voltage for a finite second period of time before subsequently connecting any other said capacitor to any said LED.

One terminal of a said capacitor may be connected to an anode of a respective LED and another terminal of the capacitor may be selectively connectable to ground via a first respective switch, and a cathode of the respective LED may be selectively connectable to ground via a second respective switch; the method may include selectively connecting a said capacitor unit to a said LED by concurrently closing both the first and second respective switches thereby to apply a said forward bias voltage to the LED, and subsequently selectively disconnecting the capacitor unit from the LED by concurrently opening both the first and second respective switches.

The method may include sequentially connecting different said capacitor units to different said LEDs of the different colours such that each said colour is displayed in turn before a given colour is re-displayed.

DETAILED DESCRIPTION

Figure 1:
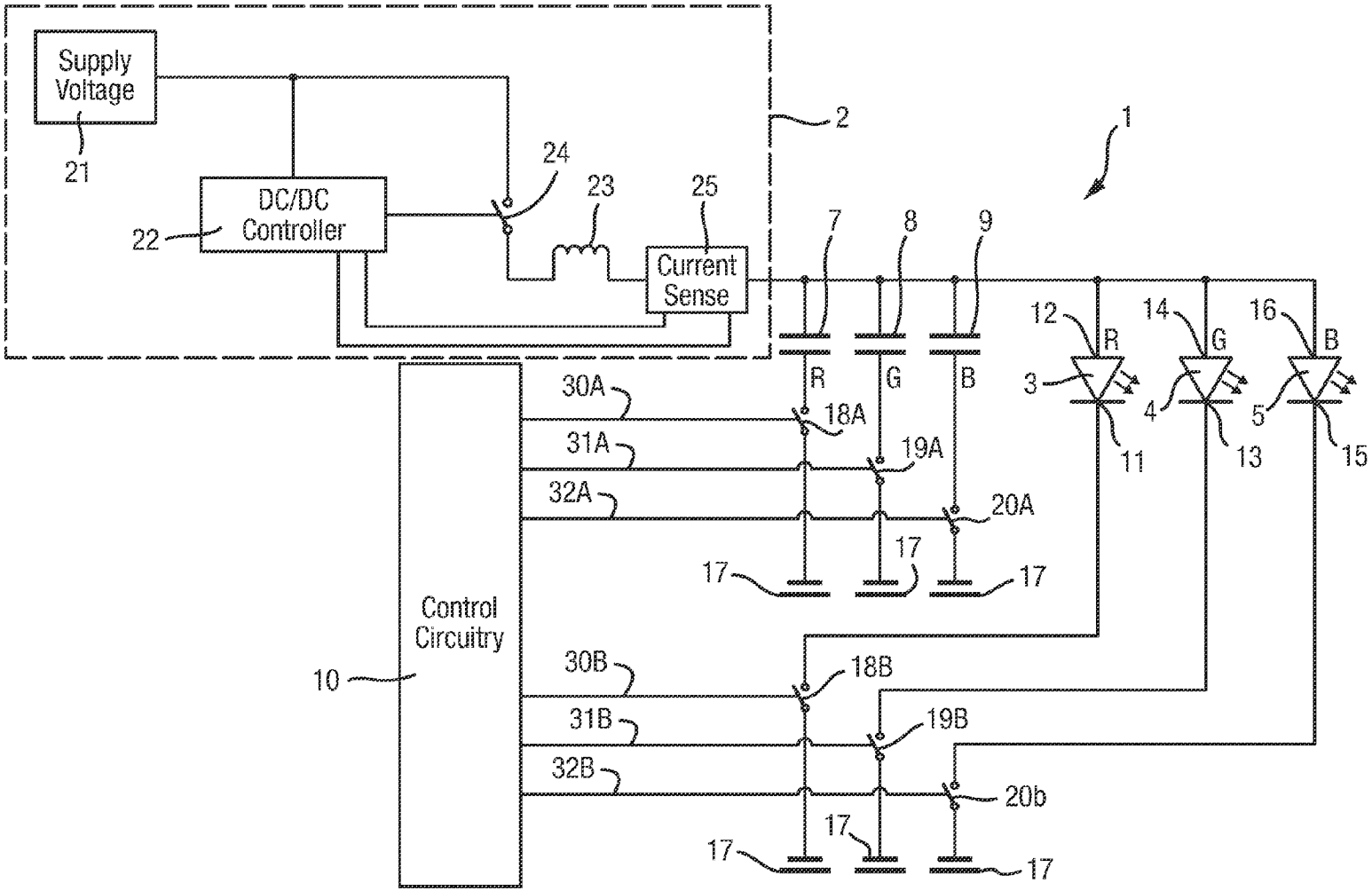
FIG. 1 schematically shows a colour display apparatus according to a first embodiment of the invention.

In the drawings like reference symbols refer to like items.

Figure 2:
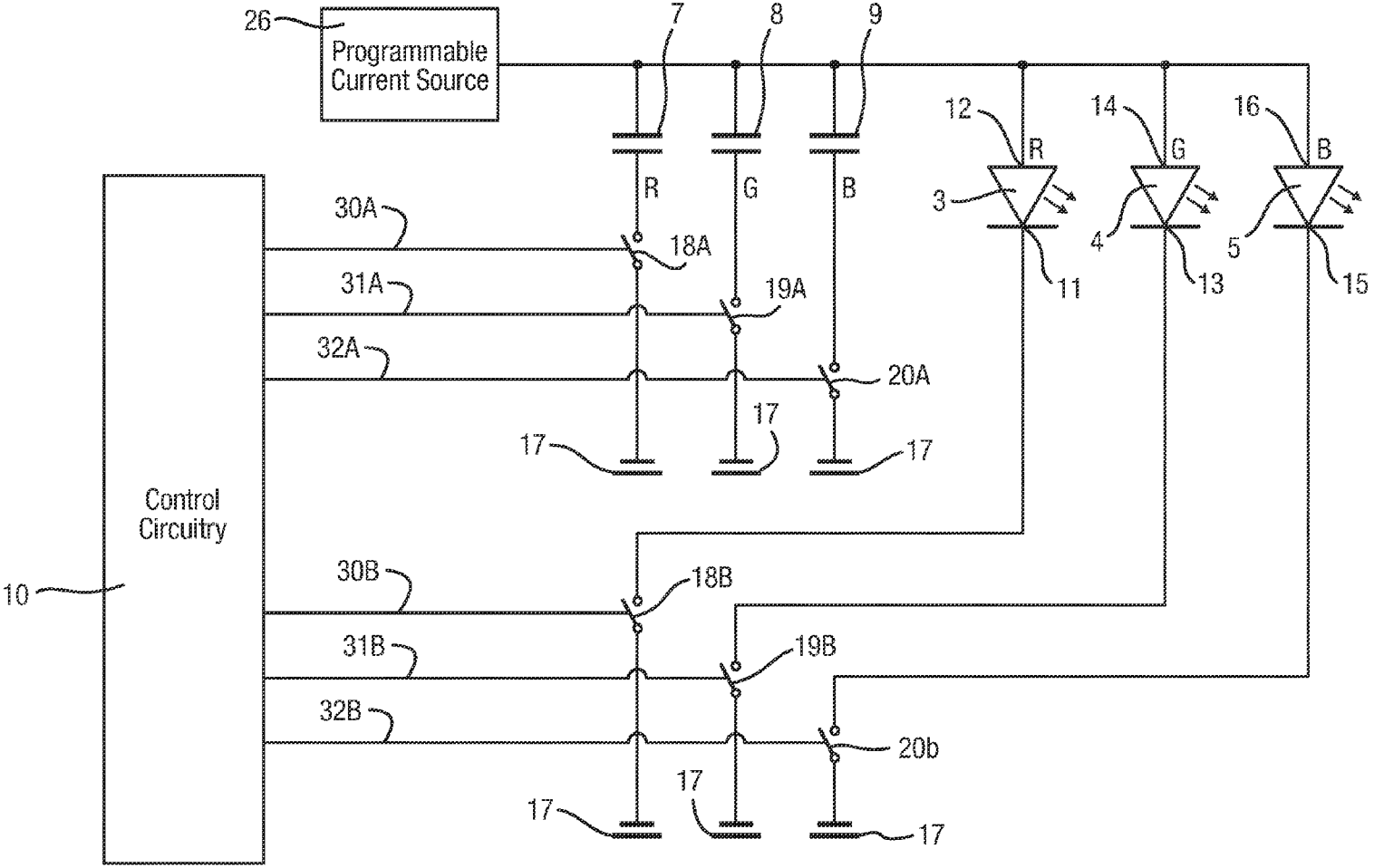
FIG. 2 schematically shows a colour display apparatus according to a first embodiment of the invention.

FIG. 1 and FIG. 2 each shows a schematic diagram of an RGB colour display apparatus 1 according to an embodiment of the invention, for displaying light at optical wavelengths corresponding each one of three different primary colours (red, green, blue) sequentially. The apparatus comprises plurality of light-emitting diodes (3, 4, 5) each respectively dedicated to produce light to display a respective one of the three different primary colours. A first LED 3 is arranged to generate and display red light in use, a second LED 4 is arranged to generate and display green light in use, and a third LED is arranged to generate and display blue light in use. The red LED may preferably be arranged to generate a light output spectrally peaking at a wavelength of about 621 nm, with a spectral width of about 40 nm. The green LED may preferably be arranged to generate a light output spectrally peaking at a wavelength of about 525 nm, with a spectral width of about 100 nm. The blue LED may preferably be arranged to generate a light output spectrally peaking at a wavelength of about 460 nm, with a spectral width of about 50 nm. The anodes of each of three LEDs are collectively connected in parallel to a common power source (item 2, FIG. 1; item 26, FIG. 2) which is arranged for supplying power to the LEDs. The power source is what is known in the art as a "constant current" power source and is arranged to supply a steady electrical current to the LEDs having a size (amps) according to the brightness of luminous output required of the LED being supplied. Suitable such power sources are readily available to the skilled person. For example, in FIG. 1, a constant voltage source 21 is electrically connected to a DC/DC control element 22 which measures current passing though a current sensor unit 25 connected in series between the voltage source 21 and one terminal of each of three separate capacitors (7, 8, 9) of the device. The control element 22 is arranged to control the state of a switching element (e.g. FET) 24 and therefore overall current. An inductor 23 is connected in series between the switching element 24 and the current sensor 25. One terminal of each of three separate capacitors (7, 8, 9) are each connected in common to the to the power source between the power output of the power source and the anodes of the three LEDs connected to the power source. This connection of the three capacitors to the power source enables them each to be provided with a respective charge for generating a respective one of three different forward bias voltages for application to a selected one of the three LEDs to which they are also connected. In so doing, a capacitor enables the conduction/operation the LED such that a controlled amount of current can be passed through the LED in question, from the power source, to cause the LED to emit coloured light at the desired brightness, flux or intensity level.

The other terminal of each one of the three capacitors is connected (or more particularly, selectively connectable) to a grounded terminal 17 via a first respective switch (18A, 19A, 20A). Similarly, the cathode (11, 13, 15) of each respective one of the three LEDs is connected (or more particularly, selectively connectable) to a grounded terminal 17 via a second respective switch (18B, 19B, 20B).

A control unit 10 is connected to each one of the three first switches (18A, 19A, 20A) and is also connected to each one of the three second switches (18B, 19B, 20B) via a respective one of six separate switch control signal lines (30A, 31A, 32A; and 30B, 31B, 32B). The switches may each be in the form of a transistor (e.g. MOSFET) switchable by application of a simple gate-control voltage signal from the control unit, applied thereto via a switch control signal line.

The control unit is arranged to selectively open or close these six switches in pairs, collectively, as desired. In particular, the control unit is operable and arranged to selectively electrically connect a selected one of the three capacitors (7, 8, 9) to a selected one of the three LEDs (3, 4, 5) by concurrently closing both the first and second respective switches that are connected to the anode and cathode of that LED. The control unit is also operable and arranged to selectively disconnect a selected one of the three capacitors from a selected LED by concurrently opening both the first and second respective switches that are connected to the anode and cathode of that LED.

In this way, the control unit 10 is operable to selectively connect a desired one of the three capacitors to a selected one of the three LEDs for applying a desired one of the different forward bias voltages to the LED. The choice of which capacitor to connect to which LED as determined according to the colour of light which the LED is operable to display and, therefore, the forward bias voltage required to operate that particular LED.

As is well known in the art, LEDs that have been designed for generating specific colours typically have specific structures and/or materials, and power ratings which differ from those of an LED arranged to output a different colour. This also means that they typically require a specific forward bias voltage to operate optimally, which differs from that required by an LED of a different colour. This applies to the three LEDs (3, 4, 5) of the display apparatus in that the red LED 3 required a bias voltage which differs from that required by the green LED or the blue LED. Similarly, the bias voltage required by the green LED differs from that required by the blue LED. Representative values for the forward bias voltages required by the three LEDs are, for example: red LED=2.2V; green LED=3.8V; blue LED=3.5V.

The three capacitors (7, 8, 9) of the display apparatus have different respective capacitance values such that, when fully charged by the power supply unit (2, 26), each stores a different respective amount of charge corresponding to a different respective one of the three different forward bias voltages of the three different LEDs. In particular, the first capacitor 7 has a capacitance arranged to generate a voltage, when fully charged, corresponding to a forward bias voltage for operating the red LED 3. Furthermore, the second capacitor 8 has a capacitance arranged to generate a voltage, when fully charged, corresponding to a forward bias voltage for operating the green LED 4. Also, the third capacitor 9 has a capacitance arranged to generate a voltage, when fully charged, corresponding to a forward bias voltage for operating the blue LED 3.

The control unit is operable and arranged to selectively electrically connect the first capacitor 7 to the red LED 3 by closing both of the first and second switches (18A, 18B) connected to the first capacitor and the red LED, thereby applying the pre-stored forward bias voltage of the first capacitor. These switches may be maintained by the control unit in the closed state for a desired period of time for rendering the red LED conductive and illuminated.

The control unit is arranged to selectively disconnect the first capacitor from the red LED to remove the desired forward bias voltage for a finite second period of time before subsequently connecting another of the three capacitors to another of the three LEDs.

In particular, the control unit is operable and arranged to subsequently electrically connect the second capacitor 8 to the green LED 4 by closing both of the first and second switches (19A, 19B) connected to the second capacitor and the green LED, thereby applying the pre-stored forward bias voltage of the second capacitor. These switches may then be maintained by the control unit in the closed state for a desired period of time for rendering the green LED conductive and illuminated.

Subsequent to the end of that period of green illumination, the control unit is operable and arranged to electrically connect the third capacitor 9 to the blue LED 5 by closing both of the first and second switches (20A, 20B) connected to the third capacitor and the blue LED, thereby applying the pre-stored forward bias voltage of the third capacitor. These switches may then be maintained by the control unit in the closed state for a desired period of time for rendering the blue LED conductive and illuminated. The cycle of red, green and blue LED illumination may then repeat as desired. The control unit may sequentially connect the first, second and third capacitor units to the red, green and blue (respectively) LEDs such that each colour is displayed in turn before that colour is re-displayed.

The control unit is arranged to receive input signals (FIG. 3) from an external control signal generator (e.g. microcontroller or control logic circuit, etc.), which convey switching sequence signals to which the control unit is responsive to generate separate pairs of concurrent switch control (enable/disable) output signals (30A to 32B) and to output the same to first and second switches associated with a common given LED. Each switching sequence signal may be of a form and structure such as is used in existing systems for controlling LEDs. However, in the present embodiment, all three switching sequence control signals are input to one common control unit, rather than in to each of three separate control circuits associated with the driving of respective colour LEDs. This provides a great saving in componentry, cost and space usage. The control unit may comprise any suitable control circuitry, or logic, such as would be readily apparent to the skilled person in the light of the present disclosure for generating such output signals in response to input signals as presently described.

The brightness of each of the red, green and blue LEDs during the period in which any is conductive, is controlled by appropriately controlling the current supplied to the LED in question at that time. This may be done according to techniques well known in the art.

A particular benefit of pre-charging the back of three capacitors to provide appropriate forward bias voltages is that the correct forward bias voltage may be applied to the necessary LED immediately it is required. There is no requirement to wait while a power supply unit generates a new forward bias voltage after having dispensed with a previous one. Rather, the required forward bias voltage is ready and waiting when needed. Each capacitor unit also acts as a current smoothing device to provide current until the power source (2, 26) is again connected to an LED.

Figure 3:
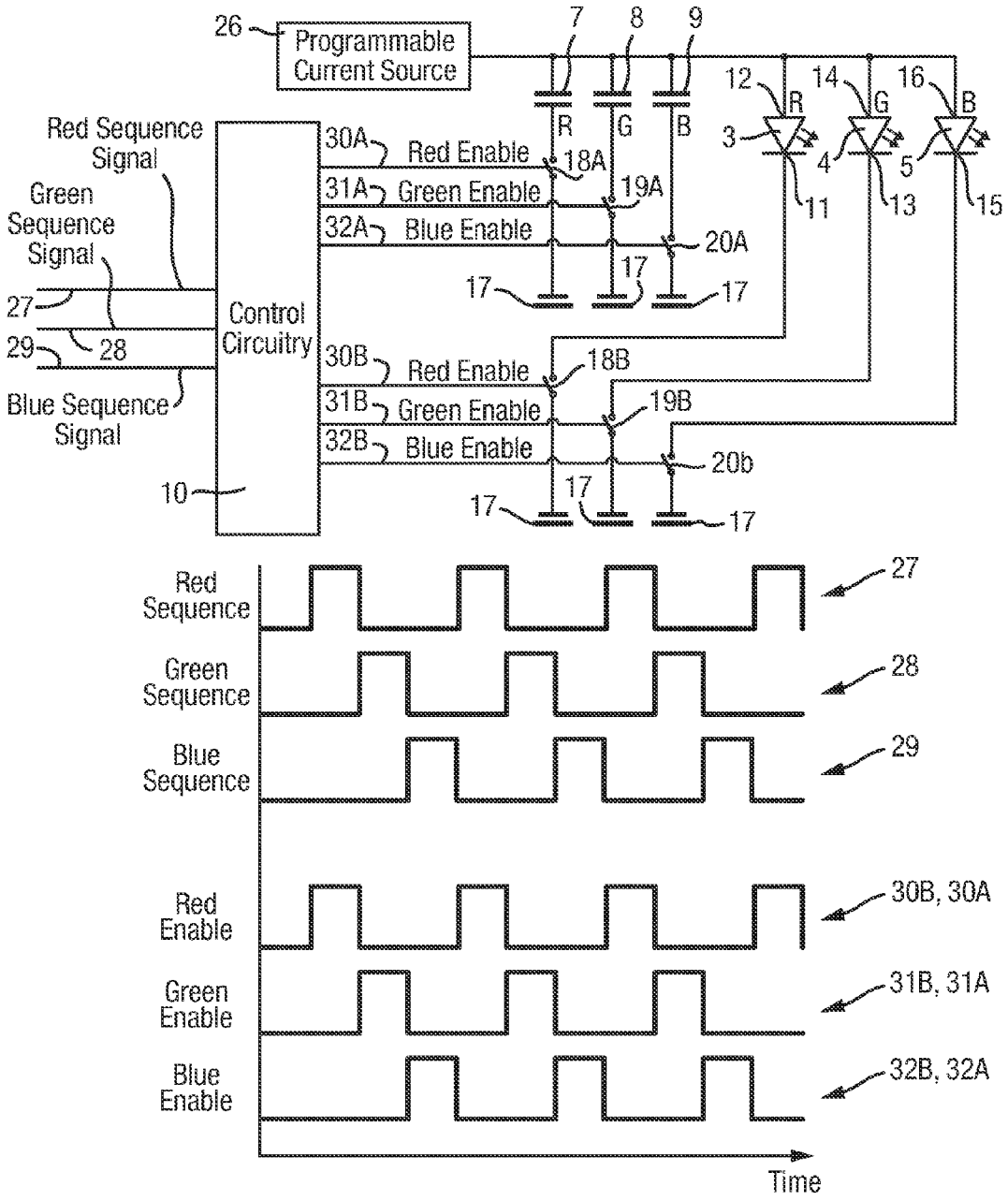
FIG. 3 schematically shows the colour display apparatus of FIG. 2 in conjunction a sequence of display control signals for controlling the display apparatus (equally applicable to the apparatus of FIG. 1)

FIG. 3 schematically illustrates an example of the operation of the display apparatus as described above.

In particular, the control unit is arranged to receive, at a signal input(s) thereof, three separate colour control sequence signals (27, 28, 29) from an external controller (not shown) of the display apparatus for controlling the display apparatus to produce a colour-sequential display output. The colour control sequence signals comprise a red sequence signal 27, a green sequence signal 28 and a blue sequence signal 29 each separately input to the control unit.

The form of each of these three colour sequence control signals is shown graphically in FIG. 3 as a sequence of square "high" pulses separated by a uniform "low" period, with each pulse having a duration substantially equal to half the duration of the "low" period. A separate such pulse sequence is provided for controlling the operation of a respective one of each of the three colour LEDs, and these three sequences are coordinated such that the pulses of any one of the three sequences are present only when the pulses of each of the other sequences are absent.

The control unit is responsive to the presence of a "high" pulse in the received red sequence signal 27 to output a switch enable signal concurrently upon each of the two switch control signal lines (30A, 30B) associated with the first capacitor thereby to electrically connect it to the red LED to apply the pre-stored forward bias voltage of the first capacitor thereto to render it conductive. Conversely, the control unit is responsive to the absence of a "high" pulse in the received red sequence signal 27 to withhold a switch enable signal concurrently from each of the two switch control signal lines (30A, 30B) associated with the first capacitor thereby to electrically disconnect it to the red LED to remove the pre-stored forward bias voltage of the first capacitor therefrom and render the LED non-conductive.

In the same way, the control unit is responsive to the presence of a "high" pulse in the received green (or blue) sequence signal 28 (or 29) to output a switch enable signal concurrently upon each of the two switch control signal lines 31A and 31B (or 32A and 32B, for blue LED) associated with the second (or third, for blue LED) capacitor thereby to electrically connect it to the green (or blue) LED to apply the pre-stored forward bias voltage of the second (or third) capacitor thereto to render it conductive. Conversely, the control unit is responsive to the absence of a "high" pulse in the received green (or blue) sequence signal 28 (or 29) to withhold a switch enable signal concurrently from each of the two switch control signal lines 31A and 31B (or 32A and 32B) associated with the second (or third) capacitor thereby to electrically disconnect it to the green (or blue) LED to remove the pre-stored forward bias voltage of the second (or third) capacitor therefrom and render the LED non-conductive.

In each case, the duration of a switch enable signal generated by the control unit 10 is equal to the duration of the "high" pulse in the associated colour sequence control signal in question.

Figure 4:
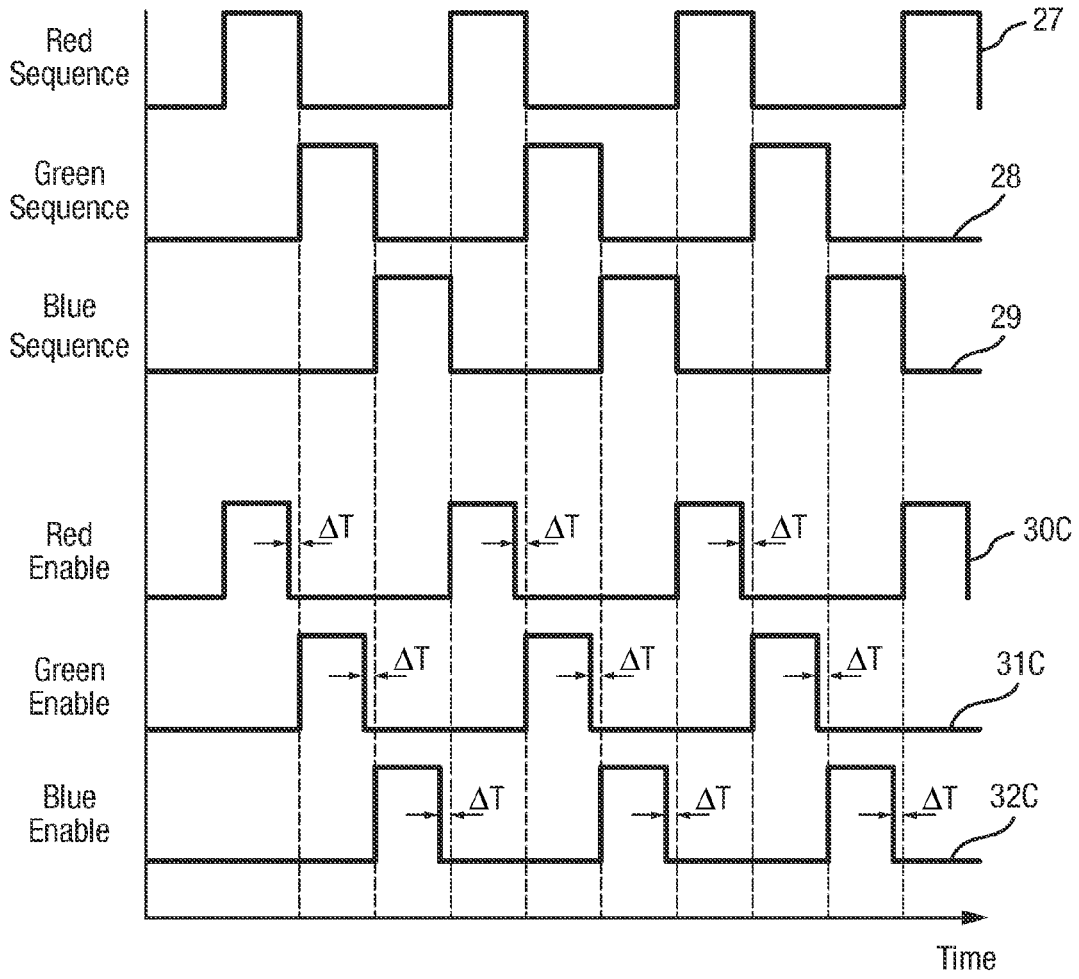
FIG. 4 schematically shows a sequence of display control signals for controlling the display apparatus of FIG. 1 or FIG. 2.

FIG. 4 shows an alternative embodiment of the control unit in which the control unit is responsive to the colour sequence control signals (27, 28, 29) such that the duration of each resulting switch enable signal, generated by the control unit 10, is less than the duration of the "high" pulse in the associated colour sequence control signal in question. In particular, upon the switch control signal lines 30A and 30B associated with first and second switches 18A and 18B for the red LED, is transmitted a (red) switch enable signal 30C; upon the switch control signal lines 31A and 31B associated with first and second switches 19A and 19B for the green LED, is transmitted a (green) switch enable signal 31C; upon the switch control signal lines 32A and 32B associated with first and second switches 20A and 20B for the blue LED, is transmitted a (blue) switch enable signal 32C. The control unit is arranged to apply a switch enable signal to a switch control signal line immediately an relevant colour sequence control signal "high" pulse of duration T is received, and to apply the enable signal for a period of time T-ΔT so that there exists a period of time ΔT (e.g. 100 ns or less) immediately after the enable signal has ended and before any successive colour sequence control signal "high" pulse (for any subsequent colour) is received. This means that, during the period ΔT between successive enable pulses, none of the LEDs is conductive, and all of the three capacitors (7, 8, 9) are electrically isolated from the LEDs. This "dead time" has the following advantages.

When switching between colour channels, the control unite is able to fully disconnect a current colour LED before switching to enable the next colour LED. This takes a short (but finite) amount of time. It has been found that if this is not done, then a potentially very damaging power surge may occur during switching as well as colour bleed in the colour display output. The disconnected time provides a period for permitting the bleeding away of an amount of accumulated gate charge on the switch units (18A, 19A, 20A, 18B, 19B, 20B), such as MOSFET devices, before switching in the next colour. This may be done to ensure there are no large power surges during transition from one colour to the next due to the typically very different drive requirements of each colour LED. The period of time ΔT is preferably not less than about 20 ns in duration, and more preferably not less than about 30 ns and even more preferably not less than about 50 ns (e.g. 100 ns).

As has been discussed above, LEDs are current mode devices; that is, the brightness of light emitted from an LED is proportional to the current flowing through it. The voltage developed across an LED varies and is determined by the current flowing through it and that current is selected according to the required illumination level. The protection mechanism used in the present invention is therefore based upon current sensing. However, as stated above, the required current level to achieve a given level of brightness differs across the different coloured LEDs by a large amount. Because of the wide disparity of currents required, a protection mechanism applying a single current limit would expose some channels to potentially catastrophic current if the limit were chosen only for the highest current device. For LEDs, the required current is highest in the red device, decreasing significantly for green and blue, in that order. To accommodate the different LED characteristics, an alternative embodiment of the present invention has been devised to provide a protection mechanism with a dynamically selectable current limit. This alternative embodiment will now be described with reference to FIG. 5, the numbering of equivalent features being preserved from the earlier figures.

Figure 5:
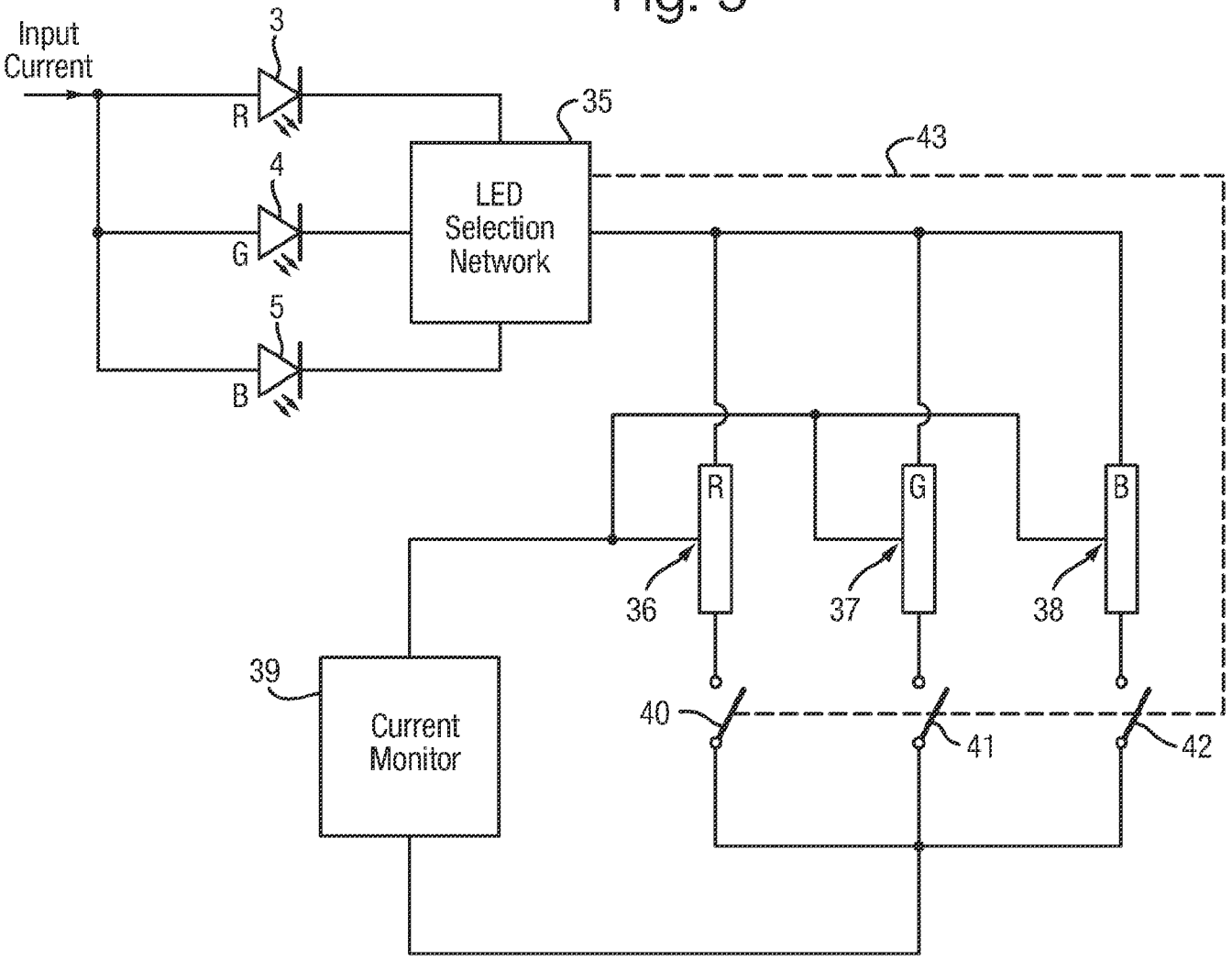
FIG. 5 schematically shows a display control apparatus according to a further embodiment of the invention.

Referring to FIG. 5, the functionality of the control circuitry 10, the switch units 18A, 18B, 19A, 19B, 20A, 20B, the control signal lines 30A, 30B, 31A, 31B, 32A, 32B and the network of capacitors 7, 8, 9 of the embodiments shown in FIG. 1 and FIG. 3 is represented as a single LED selection network 35 for selecting which of the LEDs 3, 4, 5 is to be illuminated. A current sensing network is provided, comprising three individually selectable current sensing networks 36, 37 and 38 to be associated with the red (3), green (4) and blue (5) LEDs respectively. Each current sensing network 36, 37, 38 may be linked to a current monitor 39 by means of a respective switch unit 40, 41, 42. The switch units are individually selectable from the LED selection network 35 by means of control signals sent over a current sensing network selection pathway 43.

In operation, the LED selection network 35 is arranged to select an appropriate current limit for an LED channel by outputting a current sensing network selection signal directed to the appropriate switch unit 40, 41, 42 at the same time as it selects the LED 3, 4, 5 to be in an 'ON' state, for example by means the respective switch control output signals 30A, 31A, 32A of the FIG. 1 and FIG. 3 embodiments, above. This ensures not only that the appropriate current is available for the selected LED, but also that an appropriate overcurrent limit is used. This permits normal operation of the system, but prevents a single LED failure causing a catastrophic failure of the system.

Advantageously, this dynamic method of current limit selection also permits 'reduced functionality' operation. If, for example, the red LED 3 fails either as an open circuit or as a short-circuit, this protection mechanism will still allow the blue and green channels to operate. An open device would quickly destroy the control circuitry 10 if it did not have 'open LED' protection circuitry. Many known LED controllers have this feature. When a LED fails open, the output voltage at the controller will quickly (in the order of some milliseconds) rise to levels capable of destroying the device and therefore this form of protection is highly desirable.

Significant improvements to display clarity are achievable through the present invention by deliberately defeating this known protection measure during the very short 'dead time' time period, described above, required to switch LED channels, recognising that this time period is too short for significant voltages to build up at the output of the LED controller. Inserting this dead time has two primary advantages.

1. The display does not exhibit 'wash-out' at the start of a frame. Wash-out occurs when the available power to the device is lower than desired. By preventing the controller from shutting down for this short time, this effect is eliminated.

2. The display does not suffer from channel blending. If this short amount of time between channels is not enforced, there will be a short time when two channels are 'on'. The two colours will therefore blend in the visible display. Preventing this situation eliminates this effect. By means of the embodiment shown in FIG. 5, the current limit chosen for each LED is always correct. However, without the dead time, the current limit would be unknown and not precisely controlled during the time the channels are switching, with the potential to set a limit that could cause catastrophic failure of the system.

In the present invention, the dead time period is a specifically selected and implemented system parameter. The protection provided by LED control method of the present invention ensures that the two primary failure mechanisms known to exist in LEDs are properly mitigated.

The colour display apparatus may include a display screen (not shown) comprising the three LEDs, or a multitude of groups of three colour (RGB) LEDs arranged and driven as described above and collectively providing a display. The colour display apparatus may comprise a projector part (not shown) for projecting light generated by the plurality of LEDs.

The embodiments described above are intended to provide illustrative examples of the invention to aid understanding and it will be appreciated that modifications, equivalents and variants to these embodiments, such as would be readily apparent to the skilled person, are encompassed within the scope of the invention, e.g. such as is defined by the claims.

The invention claimed is:

1. A light source for a colour display apparatus for displaying light at optical wavelengths corresponding a plurality of different colours sequentially, the light source comprising:

a plurality of light-emitting diodes (LED) each respectively operable to emit light to display a respective one of said plurality of different colours;

a power input part for connecting the plurality of LEDs to a power supply for supplying power thereto, the power input part including a plurality of current sensing units, each current sensing unit being selectable in respect of one of the plurality of LEDs to apply a corresponding limit to the level of current that may be supplied thereto by the power supply;

a plurality of capacitor units connected to the power input part to be provided with charge from a said power supply for generating a respective one of a plurality of different respective forward bias voltages for application to said LEDs to operate the LEDs; and a control unit operable to connect selectively a said capacitor unit to a said LED for applying a desired one of said different said forward bias voltages thereto according to the colour of light which the LED is operable to display and to select a corresponding one of said plurality of current sensing units for the LED.

2. A light source for a colour display apparatus according to claim 1 wherein said control unit is operable and arranged to selectively connect a said capacitor unit to a said LED for a first period of time for operating the LED, and to subsequently disconnect said capacitor unit from said LED to remove said desired forward bias voltage for a finite second period of time before subsequently connecting any other said capacitor to any said LED.

3. A light source for a colour display apparatus according to claim 1 in which one terminal of a said capacitor is connected to an anode of a respective LED and another terminal of the capacitor is selectively connectable to ground via a first respective switch, and a cathode of the respective LED is selectively connectable to ground via a second respective switch; wherein the control unit is operable and arranged to selectively connect a said capacitor unit to a said LED by concurrently closing both the first and second respective switches, and to selectively disconnect a said capacitor unit from a said LED by concurrently opening both the first and second respective switches.

4. A light source for a colour display apparatus according to claim 1 in which the control unit is operable and arranged sequentially to connect different said capacitor units to different said LEDs of said different colours such that each said colour is displayed in turn before a given colour is re-displayed.

5. A light source for a colour display apparatus according to claim 1 in which capacitor units of said plurality of capacitor units differ from one another in respect of their capacitance thereby to provide different forward bias voltages when provided with charge from said power supply.

6. A light source for a colour display apparatus according to claim 1 in which said plurality of different colours comprise substantially red, substantially green and substantially blue and each said LED is arranged respectively to emit light to display a respective one of substantially red, substantially green and substantially blue.

7. A colour display apparatus including a light source according to claim 1.

8. A light source for a colour display apparatus according to claim 1, further comprising a projector part for projecting light generated by said plurality of LEDs.

9. A head-mounted display apparatus comprising the light source for a display apparatus according to claim 1.

10. A head-up display apparatus comprising the light source for a display apparatus according to claim 1.

11. A helmet-mounted display apparatus comprising the light source for a display apparatus according to claim 1.

12. A method for use in displaying light at optical wavelengths corresponding to a plurality of different colours sequentially, the light displayed by a light source including a plurality of capacitor units connected to a power source and to a respective one of a plurality of light-emitting diodes (LED) each arranged to emit light to display a respective one of said plurality of different colours, the method comprising:

charging each capacitor from the power source thereby generating a respective one of a plurality of different respective forward bias voltages for application to said LEDs to operate the LEDs; and selectively connecting a said capacitor unit to a said LED thereby applying a desired one of said different said forward bias voltages thereto according to the colour of light which the LED is operable to display.

13. A method according to claim 12 wherein selectively connecting a said capacitor unit to a said LED includes selectively connecting a said capacitor unit to a said LED for a first period of time for operating the LED, and subsequently disconnecting said capacitor unit from said LED to remove said desired forward bias voltage for a finite second period of time before subsequently connecting any other said capacitor to any said LED.

14. A method according to claim 12 in which one terminal of a said capacitor is connected to an anode of a respective LED and another terminal of the capacitor is selectively connectable to ground via a first respective switch, and a cathode of the respective LED is selectively connectable to ground via a second respective switch; the method including selectively connecting a said capacitor unit to a said LED by concurrently closing both the first and second respective switches thereby to apply a said forward bias voltage to the LED, and subsequently selectively disconnecting said capacitor unit from said LED by concurrently opening both the first and second respective switches.

15. A method according to claim 12, wherein sequentially connecting different said capacitor units to different said LEDs of said different colours includes displaying each said colour in turn before a given colour is re-displayed.

16. A display apparatus for displaying light at optical wavelengths corresponding a plurality of different colours sequentially, the apparatus comprising:

a plurality of light-emitting diodes (LED) each respectively operable to emit light to display a respective one of said plurality of different colours;

a plurality of current sensing units, each current sensing unit being selectable in respect of one of the plurality of LEDs to apply a corresponding limit to current that may be supplied thereto by a power supply;

a plurality of capacitor units to be provided with charge from a said power supply for generating a respective one of a plurality of different respective forward bias voltages for application to said LEDs to operate the LEDs, wherein capacitor units of said plurality of capacitor units differ from one another in respect of their capacitance thereby to provide different forward bias voltages when provided with charge from said power supply; and a control unit operable to connect selectively a said capacitor unit to a said LED for applying a desired one of said different said forward bias voltages thereto according to the colour of light which the LED is operable to display and to select a corresponding one of said plurality of current sensing units for the LED, and wherein said control unit is further operable and arranged to selectively connect a said capacitor unit to a said LED for a first period of time for operating the LED, and to subsequently disconnect said capacitor unit from said LED to remove said desired forward bias voltage for a second period of time before subsequently connecting any other said capacitor to any said LED.

17. A display apparatus according to claim 16 in which the control unit is operable and arranged sequentially to connect different said capacitor units to different said LEDs of said different colours such that each said colour is displayed in turn before a given colour is re-displayed.

18. A head-mounted display comprising the display apparatus according to claim 16.

19. A head-up display comprising the display apparatus according to claim 16.

20. A helmet-mounted display comprising the display apparatus according to claim 16.

* * * * *